United States Patent [19]

Springer

[11] Patent Number: 4,621,781

[45] Date of Patent: Nov. 11, 1986

[54] ERGONOMIC FOREARM REST FOR USE WITH KEYBOARDS

[75] Inventor: Timothy J. Springer, St. Charles, Ill.

[73] Assignee: Marvel Metal Products Co., Chicago, Ill.

[21] Appl. No.: 734,489

[22] Filed: May 16, 1985

[51] Int. Cl.[4] ..... A47F 7/100

[52] U.S. Cl. ..... 248/118; 400/715

[58] Field of Search ..... 248/118, 118.1, 118.3, 248/118.5, 1 B; 211/69.1; 400/715; 340/365 C, 365 R; 361/222

[56] References Cited

U.S. PATENT DOCUMENTS

| | | | |
|---|---|---|---|
| 4,481,556 | 11/1984 | Berke et al. | 248/118 |
| 4,482,063 | 11/1984 | Berke et al. | 248/118 |
| 4,482,064 | 11/1984 | Berke et al. | 248/118 |
| 4,483,634 | 11/1984 | Frey et al. | 400/715 |

FOREIGN PATENT DOCUMENTS

| | | | |
|---|---|---|---|
| 1913287 | 9/1970 | Fed. Rep. of Germany | 400/715 |
| 2203265 | 8/1973 | Fed. Rep. of Germany | 400/715 |
| 395875 | 1/1966 | Switzerland | 248/118 |
| 2074948 | 11/1981 | United Kingdom | 400/715 |

OTHER PUBLICATIONS

Promotional Brochure entitled, "The Electronic Environment ®", by Marvel Metal-p. 7, Figure C.

*Primary Examiner*—J. Franklin Foss
*Assistant Examiner*—David L. Talbott
*Attorney, Agent, or Firm*—Edgar A. Zarins; Malcolm L. Sutherland; Leon E. Redman

[57] ABSTRACT

An ergonomic forearm rest for supporting the forearms of workers engaged in high intensity keying tasks to alleviate tension and stress in the upper arms and shoulders which comprises support means for attaching the rest to a work surface supporting a keyboard, such as a base plate adapted to have the keyboard sit upon the rear portion thereof support a keyboard when being used, cushion means adapted to support the forearms of workers using said keyboard, means for securing the cushion means to a forward edge of the support means including spring-loaded hinge means normally maintaining the cushion means in a horizontal position, means for adjusting the position of the cushion means on the support means to vary the distance between the cushion means and the keyboard, and means for limiting the angle of tilt of the cushion means. The support means, e.g. base plate, preferably includes stop means. e.g. a flange abutting the work surface upon which the keyboard rests, to prevent sliding movement of the forearm rest upon the work surface and assist in maintaining the position of the cushion means relative to the keyboard. The upper surface of the cushion means has a raised center plateau, and two outer side sections that are connected to the center plateau by sloping side sections. The surface of the sloping side sections begins at either side of the center plateau and extends forward at an outward angle to the centerline of the cushion means and the surface of the sloping side sections has a larger surface area at the forward portion thereof than at the rear portion.

12 Claims, 6 Drawing Figures

FIG. 1.
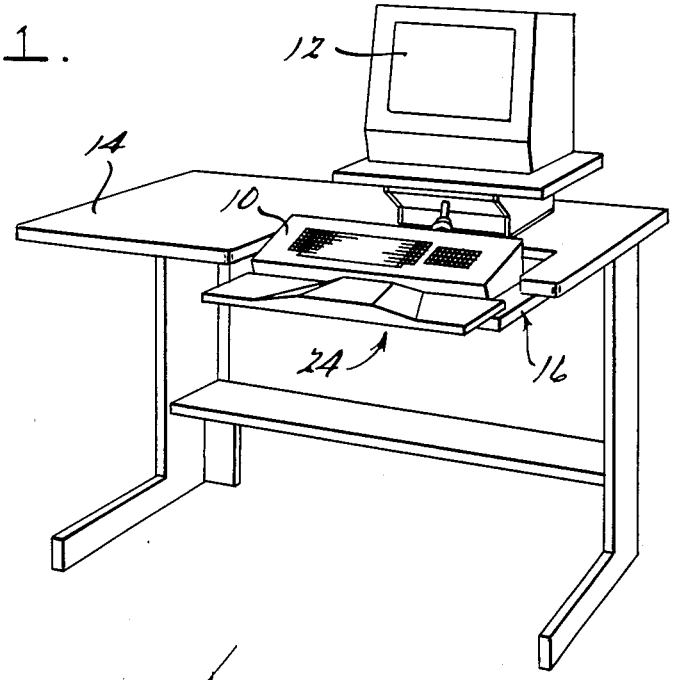
FIG. 2.
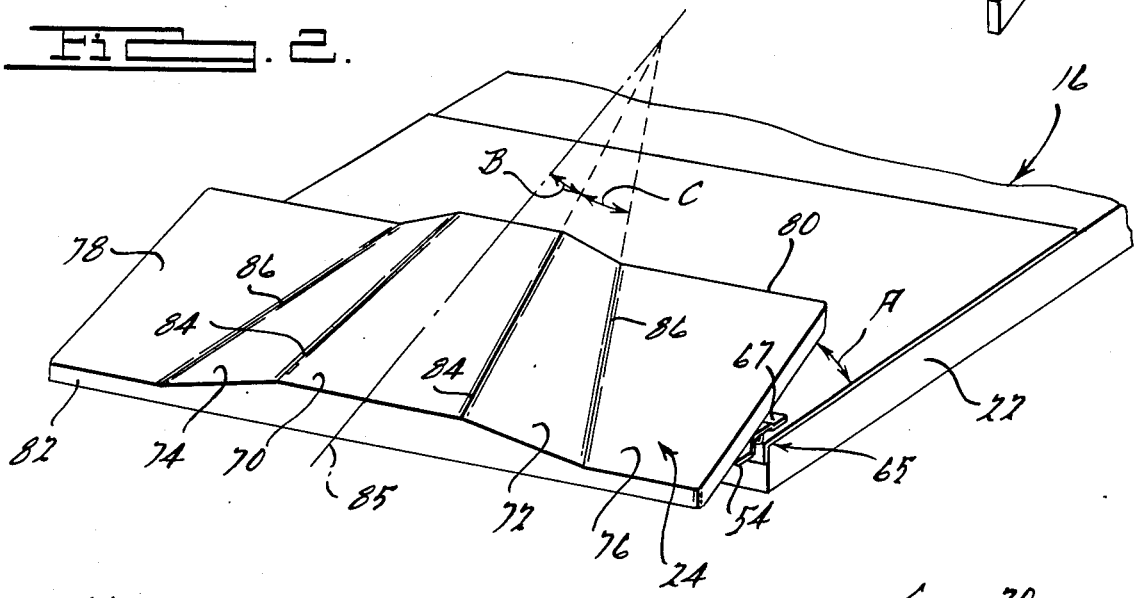
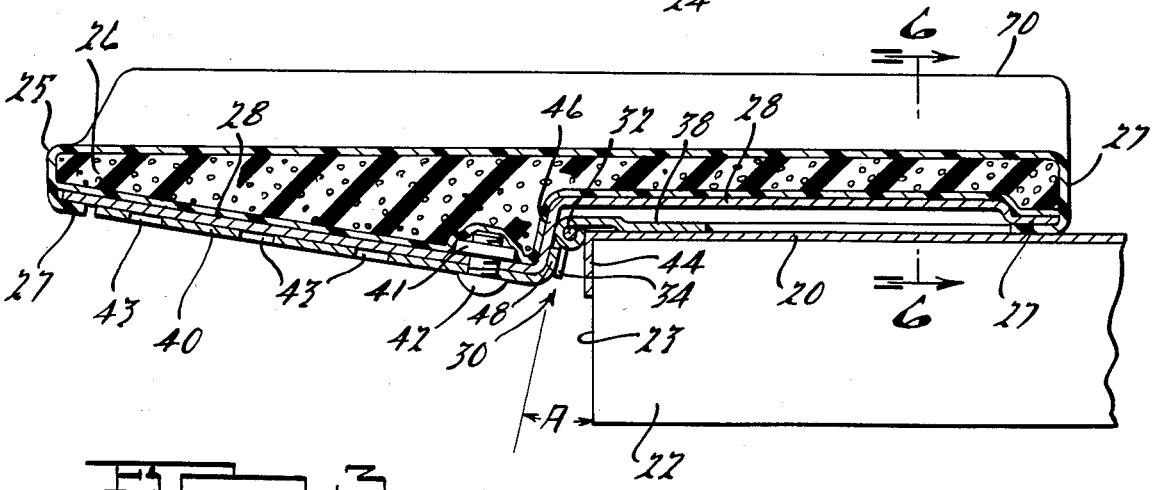
FIG. 3.

ERGONOMIC FOREARM REST FOR USE WITH KEYBOARDS

TECHNICAL FIELD

The ergonomic forearm rest of the present invention is designed to support the forearms of workers to alleviate tension and stress in the upper arms and shoulders of such workers when engaged in high intensity, high frequency keying tasks or in "conversational" keying tasks where keying is interrupted, e.g. to wait for computer operation. Rests available on the market today for use with keyboards do little more than support the palm and wrist.

BACKGROUND OF THE INVENTION

A study by Grandjean, et. al. for the Department of Hygiene and Ergonomics of the Swiss Federal Institute of Technology in 1982 examined workers performance using standard keyboards for use with video display terminals manufactured by IBM and Raytheon. The keyboards were standard models having a home row height of 80 mm above the desk level. A forearm-wrist support that was flat and fixed at an 18° angle was provided the workers. The study reports that 83% of the subjects rested their forearms when the device was present; however, over half the subjects rested their wrists when no such device was present. When asked to judge the comfort related to the forearm support, 80% indicated the presence of the forearm-wrist support was comfortable, while 3% found it uncomfortable. To rest the hands on the desk surface was found comfortable by 52% of the subjects and uncomfortable by 21% of the subjects.

The present invention is designed to provide support to the forearm and to overcome several disadvantages to the forearm-wrist support used in the Grandjean et. al. study. The design of the present invention comprises a forearm rest which, preferably, comprises cushion means having a surface designed to support the forearm during keyboard activities, means to adjust the position of the cushion means to provide a variable distance from the keyboard and cushion means to accommodate the largest number of users and keyboards, means for tilting the cushion means to a desired angle and means to support the forearm rest on the work surface supporting the keyboard and means to keep the rest from sliding with respect to such work surface during use of the keyboard. The cushion means is made of a rigid member covered by padded material and is hinged so as to tilt with respect to the horizontal and thereby accommodate various keyboard thicknesses and users of different sizes. The angle of tilt is variable between horizontal and a maximum angle selected for comfort. Additionally, the upper surface of the hinged, padded cushion means of the present invention is rolled at the edges and slopes outwardly to each side from a raised center plateau providing a raised center portion and to either side of the centerline of this raised center portion a sloping surface and a flat outer surface. The sloping surface begins at either side of the raised center portion and extends forward, i.e. away from the keyboard, at an outward angle to the centerline of the rest to conform the surface of the forearm rest to the natural resting position of the forearms when the hands are placed in the home row position on the keyboard. Additionally, in the preferred embodiment, these sloping surfaces have a larger surface area at the forward portion thereof, i.e., away from the keyboard. The configuration of this sloping surface is an important characteristic of the present invention. If one observes the forearms in a relaxed position on a rest, it is noted they are rolled slightly outward. Thus, to maximize the support of a flat surface, the forearms must be rotated inward placing undue stress on the wrist and forearm which is transmitted to the upper arm and shoulder causing fatigue. The outward slope and surface area design of the present invention, however, conform to the natural resting curve of the forearm. The angle of the slope away from the centerline conforms to the position the forearms assume when the hands move to the center of the keyboard. Furthermore, as the hands of the keyboard user move across the keyboard and the forearms roll or rotate, the wider surface area of the sloping surface at the forward portion continuously supports the broader surface of the user's forearms during such rotation, thereby maximizing the support of the forearms and reducing fatigue of the upper arms and shoulders.

OBJECTS AND ADVANTAGES OF THE INVENTION

Accordingly, it is an object of this invention to provide a simple and efficient forearm rest to alleviate tension and stress in the upper arm and shoulder of workers engaged in high intensity, high frequency keyboard activities, such as word processing, and in "conversational" keying tasks.

BRIEF DESCRIPTION OF THE DRAWINGS

The above mentioned and other features, objects and advantages and the manner of attaining them are described more specifically below by reference to an embodiment of this invention shown in the accompanying drawings, wherein:

FIG. 1 is an overall view illustrating use of the forearm rest of the present invention;

FIG. 2 is a plan view of the forearm rest of the present invention in the position of normal use;

FIG. 3 is a cross-sectional view of a first embodiment of the present invention;

DETAILED DESCRIPTION OF THE DRAWINGS

Figure 4:
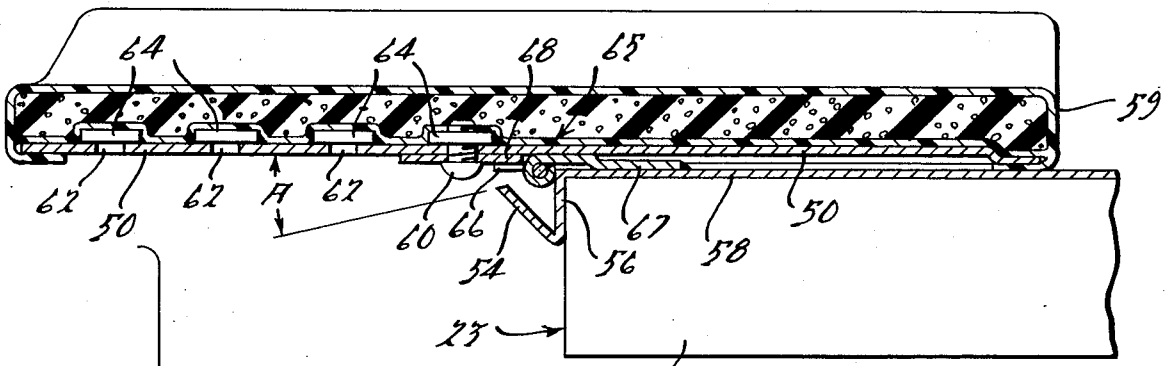
FIG. 4 is a cross-sectional view of a second, preferred embodiment of this present invention.

Referring to the figures, FIG. 1 illustrates the forearm rest of the present invention as used with a keyboard 10, video display terminal 12 and desk 14 having an adjustable keyboard station 16. As more specifically shown in FIG. 2, the forearm rest of the present invention comprises support means for supporting the forearm rest in a fixed position relative to the keyboard on the work surface upon which the keyboard sits. This support means, as shown, comprises a metal base plate 20 to which the forearm rest is attached and upon which the keyboard sits. Alternatively, the metal plate can be bolted to the work surface upon which the keyboard rests and the extension upon which the keyboard sits can be omitted. Metal plate 20 sits on work surface 22 of keyboard station 16. Cushion 24 of the forearm rest is secured at one edge of the metal base plate 20 as shown in FIGS. 3 and 4. The metal base plate 20 may be backed with a non-slip surface, an adhesive or non-slip pads.

In the first embodiment of the invention, of FIG. 3, cushion 24 comprises a self-skinning urethane pad which comprises an outer skin 25 and an inner foam material 26 secured to a metal backing plate 28 by a force fit through lips 27. Plate 28 is secured to the metal base plate by a spring-loaded hinge, generally shown at 30 which permits the pad to be tilted at an angle to accommodate various keyboard thicknesses and people of different sizes. In this embodiment, the hinge comprises piano hinge 32 which extends the width of the base plate and has three or four springs 34 which normally hold the cushion in a horizontal position. Leaf 38 of the hinge 32 is spot welded to base plate 20. Hinge 32 is secured to the backing plate 28 by screws 42 which extend through hinge leaf 40, and are secured into weld nuts 41, which as shown, extends a distance along the backing plate 28. Four or five screws 42 and weld nuts 41 are provided across the width of the forearm rest to securely attach it to hinge leaf 40. A series of screw holes 43 are provided in backing plate 28 to permit adjustment of the cushion with respect to the keyboard. Flange 44 on base plate 20 abuts the edge of keyboard station 16. The backing plate 28 and leaf 40 are bent at 46 and 48, respectively, so that upon tilting of the cushion 26, the surface 48 will abut flange 44 and allow the cushion 24 to be tilted a maximum angle A. It has been found the most desirable angle in order to conform to the natural resting position of the forearms of the most number of subjects when the hands are placed in the home row position is to provide a maximum angle of about 15°. Too large of an angle provides such flexibility that the forearm rest becomes uncomfortable to the user who is attempting to maintain a relatively stationary position of the forearm with respect to the keyboard. Flange 44 also provides a stop which abuts against the end surface 23 of keyboard station 22 to maintain the position of the forearm rest cushion 24 with respect to the keyboard 10 and prevent the forearm rest from shifting during use and movement of the rest. The distance between the leading edge 27 of the cushion 24 and the keyboard is adjustable by selecting the proper screw hole 43 to obtain the desired distance. In use, the forearm rest will be at an angle and the weight of the user's forearms will keep flange 44 pushed against the edge 23 of the keyboard station, thereby holding the forearm rest in a fixed position and maintaining the desired, preselected distance between the cushion 24 and keyboard 10.

Figure 5:
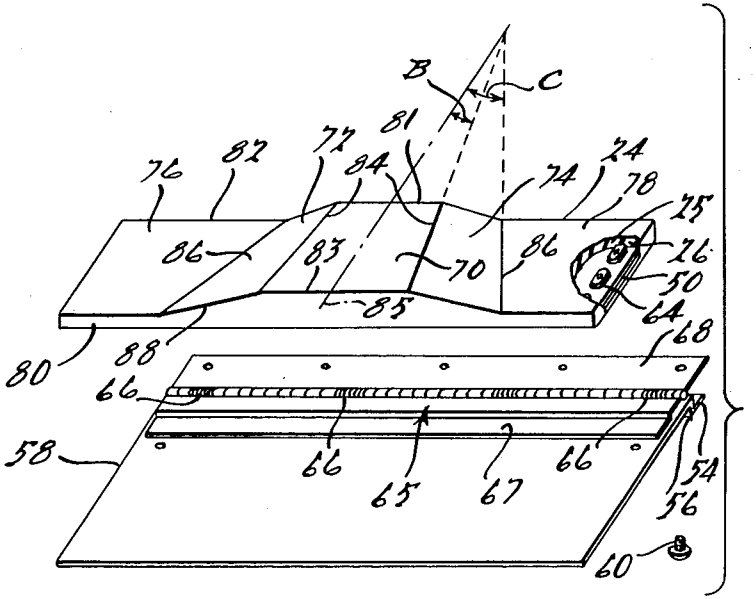
FIG. 5 is a view of the second embodiment of the present invention showing its assembly.

A second preferred embodiment of the present invention is illustrated in FIGS. 4 and 5. Backing plate 50 for the forearm rest cushion 24 is flat. In this embodiment, the maximum angle A of the forearm rest is determined by metal flange 54 which forms a part of base plate 56 together with flange 56 which abuts against the keyboard station in a manner similar to flange 44. In this embodiment, when the forearm rest tilts, the backing plate 50 abut flange 54 and the angle A of tilt is limited.

The distance between the front edge 58 of the forearm rest cushion 24 and the keyboard is adjusted in this embodiment by screws 60 and a series of screw holes 62, each of which has a complementary weld nut 64 adhered to backing plate 50. By selecting the position of the screw holes, the position of the forearm rest, when attached to the bottom plate, can be adjusted with respect to the keyboard. Like the first embodiment, a spring-loaded hinge, generally at 65, maintains the cushion in a horizontal position but permits the cushion to be tilted angle A. Leaves 67 and 68 are welded to plates 58 and 50, and springs 66 maintain the cushion in a horizontal position when not in use. As shown in FIG. 5, there are four springs 66 and five screws 60 used in this embodiment.

Figure 6:
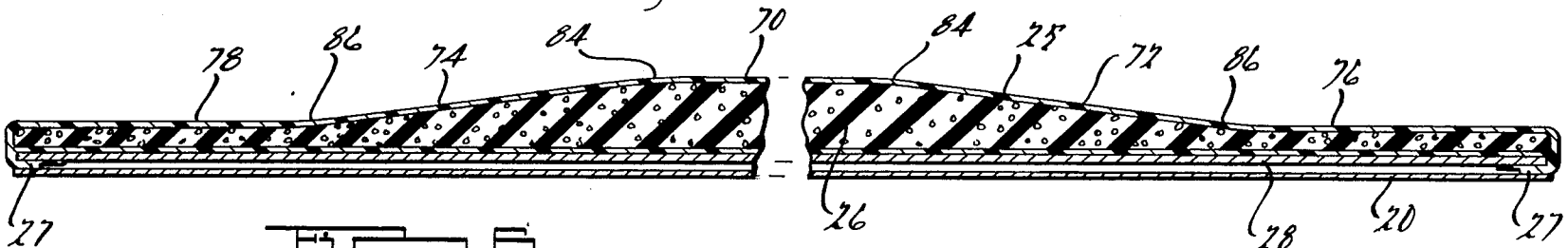
FIG. 6 is a front plan view of the cushioned forearm rest.

The preferred embodiment of the forearm rest cushion 24 of this invention, as illustrated in FIGS. 5 and 6, comprises a self-skinning urethane pad comprising a foam interior 26 and an outer skin 25, the upper surface of which has a raised center plateau 70, sloping inner side sections 72, 74 and flat, lower, outer side sections 76, 78. Sides 72, 74 slope outwardly to each side of the raised plateau 70, to the lower outer side sections 76, 78 which themselves have a generally horizontal upper surface, see FIG. 6. The edges of cushion 24 are rolled to avoid sharp edges. Sloping sections 72, 74 also have a smaller surface area toward the forward edge 80 of the cushion and a smaller surface area toward the rear edge 82 of the cushion. The slope provided between the outer side surface and the center plateau begins at the side 84 of the center plateau 70 and at an angle B to the centerline 85, generally about 5° to 10°, of the cushion 24 and terminates at side 86 of, for example, side surface 76 which is at an angle C to the centerline 85 of the cushion 24, generally about 15° to 25°. Angle B is smaller than angle C such that the surface area of the sloping surfaces is larger at edge 82 than at edge 80. The larger surface area is determined generally by the length of side edges 81 and 83 of center plateau 70 wherein edge 83 is generally about 20% to 50%, , preferably by about 25% to 40%, longer than side edge 81 in combination with angles B and C as defined above. The surface sections 72 and 74 thereby conform to the natural resting position of the forearms when the hands are placed in the home row position of the keyboard, and provide support to the forearm as it rotates during use of the keyboard. The forearm rest shown in FIG. 4 with the following dimensions for the cushion:

Overall Width: 20 inches
Overall Depth: 6 inches
Plateau 70 Thickness: 1 inch
Sections 76,78 Thickness: $\frac{1}{2}$ inch
Angle B: 8°
Angle C: 20°
Edge 81: $4\frac{3}{4}$ inches
Edge 83: $6\frac{1}{2}$ inches provides a slope of about 7° and a width between edges 86 of fourteen and one-half inches so that the forearms of a user of the rest naturally rest and has been shown to be comfortable when the hands move to the center of the keyboard in use and, the forearms rotate slightly. In this device the overall depth including plate 58 was variable between $12\frac{3}{4}$ inches and $15\frac{3}{4}$ inches and the depth of plate 58 was about eleven inches rearward from flange 56.

While there is described above the principles of this invention in connection with specific apparatus, it is to be clearly understood that this description is made only by way of example and not as a limitation to the scope of the invention:

I claim:

1. An ergonomic forearm rest for supporting the forearms of workers engaged in keying tasks to alleviate tension and stress in the upper arms and shoulders comprising a support means adapted to be attached to a work surface for supporting a keyboard, and cushion means for supporting the forearms of workers using the keyboard, means for adjusting the position of the cushion means relative to the work surface and the keyboard, means for tiltably securing said cushion means to said support means including spring-loaded hinge means normally maintaining said cushion means in a horizontal position, the upper surface of said cushion means having a raised center plateau and two outer, lower side sections each connected to the center plateau by a sloping side section, the upper surface of each sloping side section beginning at either side of the raised cneter plateau and extending forward with respect to the support means at an outward angle to the centerline of the cushion means.

2. An ergonomic forearm rest as defined in claim 1 wherein the upper sufacę of the sloping side sections has a larger surface area at the forward portion thereof than at the rearward portion.

3. An ergonomic forearm rest as defined in claim 2 further including means for limiting the angle of tilt of the cushion means.

4. An ergonomic forearm rest as defined in claim 3 further including stop means for preventing sliding movement of the support means upon the work surface.

5. An ergonomic forearm rest as defined in claim 1 wherein the support means is a base plate which rests upon the work surface and upon which the keyboard is adapted to sit during use.

6. An ergonomic forearm rest as defined in claim 5 wherein the upper surface of the sloping side sections has a larger surface area at the forward portion thereof than at the rearward portion.

7. An ergonomic forearm rest as defined in claim 6 further including means for limiting the angle of tilt of the cushion means.

8. An ergonomic forearm rest as defined in claim 7 further including stop means for preventing sliding movement of the base plate upon the work surface.

9. An ergonomic forearm rest for supporting the forearms of workers engaged in keying tasks to alleviate tension and stress in the upper arms and shoulders comprising a support means adapted to be attached to a work surface for supporting a keyboard, and cushion means for supporting the forearms of workers using the keyboard, means for tiltably securing said cushion means to said support means including spring-loaded hinge means normally maintaining said cushion means in a horizontal position, the upper surface of said cushion means having a raised center plateau and two outer, lower side sections each connected to the center plateau by a sloping side section, the upper surface of each sloping side surface beginning at either side of the raised center plateau and extending forward with respect to the support means at an outward angle to the centerline of the cushion means, the upper surface of the sloping side sections having a larger surface area at the forward portion thereof than at the rearward portion.

10. An ergonomic forearm rest as defined in claim 9 further including means for limiting the angle of tilt of the cushion means.

11. An ergonomic forearm rest as defined in claim 10 further including stop means for preventing sliding movement of the support means upon the work surface.

12. An ergonomic forearm rest as defined in claim 9 wherein the support means is a base plate which rests upon the work surface and upon which the keyboard is adapted to sit during use.

* * * * *